United States Patent [19]

Kato et al.

[11] 4,127,363

[45] Nov. 28, 1978

[54] SWASH-PLATE TYPE COMPRESSOR

[75] Inventors: Kimio Kato; Mitsuhiro Hattori, both of Kariya; Tsuneo Sugiura, Hekinan, all of Japan

[73] Assignee: Kabushiki Kaisha Toyoda Jidoshokki Seisakusho, Aichi, Japan

[21] Appl. No.: 857,859

[22] Filed: Dec. 6, 1977

[30] Foreign Application Priority Data

Dec. 16, 1976 [JP] Japan ..... 51-169599[U]

[51] Int. Cl.[2] ..... F01M 1/06; F01B 1/14

[52] U.S. Cl. ..... 417/269; 184/6.17

[58] Field of Search ..... 417/269, 270, 271; 184/6.17

[56] References Cited

U.S. PATENT DOCUMENTS

| | | | |
|---|---|---|---|
| 3,085,514 | 4/1963 | Bodzich | 417/269 |
| 3,838,942 | 10/1974 | Pokorny | 417/269 |
| 3,888,604 | 6/1975 | Oshima | 417/269 |

FOREIGN PATENT DOCUMENTS

| | | | |
|---|---|---|---|
| 230,969 | 3/1976 | France | 417/269 |
| 482,073 | 12/1953 | Italy | 417/269 |

*Primary Examiner*—William L. Freeh

*Attorney, Agent, or Firm*—Browdy and Neimark

[57] ABSTRACT

A swash-plate type compressor wherein a valve plate confronting an oil reservoir is provided with a vertical oil passage therein which is communicated with the oil reservoir via a relatively large through-bore formed at the lower end thereof, and is also provided with a gas inducing bore of a small diameter at a slightly higher position than the oil level in the oil reservoir for communicating therewith. By means of advantageously utilizing the pressure difference between the inside of the oil reservoir and that of the suction chamber as well as the centrifugal force caused by the rotation of the driving shaft and the swash-plate, the oil in the reservoir can be carried up together with the blow-up gas to each of the places requiring appropriate lubrication through two of the passages for the mixture of gas and oil, tandem arranged, large diametered and then small diametered, bored through the driving shaft, and a plurality of oil distribution bores formed in the boss of the swash-plate.

6 Claims, 3 Drawing Figures

SWASH-PLATE TYPE COMPRESSOR

BACKGROUND OF THE INVENTION

This invention relates to a swash-plate type compressor used in a vehicle air-conditioning apparatus, more particularly, to the lubrication of the swash-plate and related sliding members.

Various compulsory oiling systems employing an oil pump have been conventionally adopted for lubricating this kind of sliding structure. This way of lubrication utilizing an oil pump is said defective in that relatively large number of parts are required for the pumping structure and fairly high dimensional precision in parts manufacturing is needed because of assemblying a complicated device, inducing naturally high production cost. Other devices, which do not employ an oil pump, have also been practised for lubricating the swash-plate and other sliding parts, in one of which the oil separated from the refrigerant gas is directly lead to the sliding members, without returning straight to the oil reservoir (or a tank), by utilizing the centrifugal force at the swash-plate or the driving shaft. In this type of oiling device, lubrication under a high speed running is good enough; but once the machine comes down to a low speed operation, especially when the engine is in a low speed starting condition oil supplying will be insufficient, aptly inviting a shortage of lubrication.

SUMMARY OF THIS INVENTION

It is therefore a primary object of this invention to provide a swash-plate type compressor of simple structure, without using an oil pump, eliminating the abovementioned defects inevitable to the conventional ones.

It is another object of this invention to provide a swash-plate type compressor which is high efficient not only in high speed running period but also in low speed running period.

It is still another object of this invention to provide a swash-plate type compressor of improved structure for achieving the object of high efficient lubricating at all times and low cost manufacturing thereof.

DETAILED DESCRIPTION OF THE PREFERRED EMBODIMENT

Figure 1:
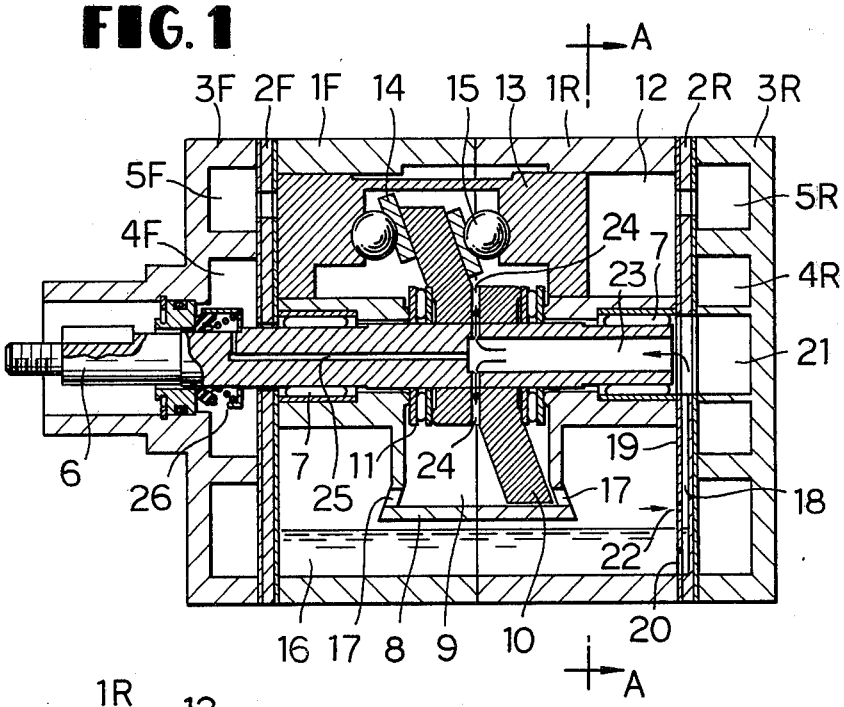
FIG. 1 is a vertical cross sectional view of a swash-plate type compressor in accordance with this invention.
Figure 2:
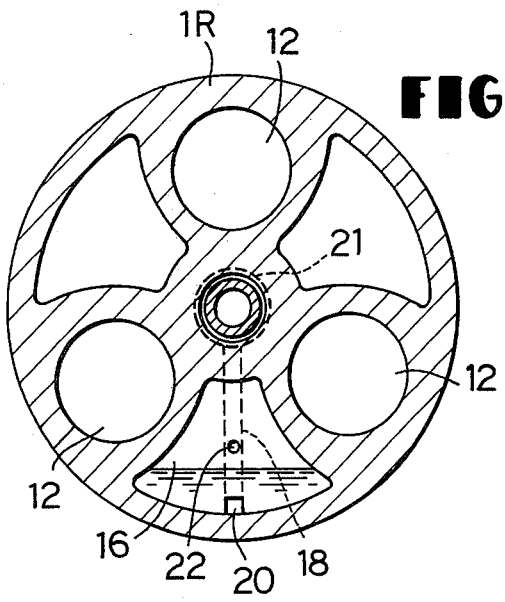
FIG. 2 is a cross sectional view taken along the line A—A of FIG. 1.
Figure 3:
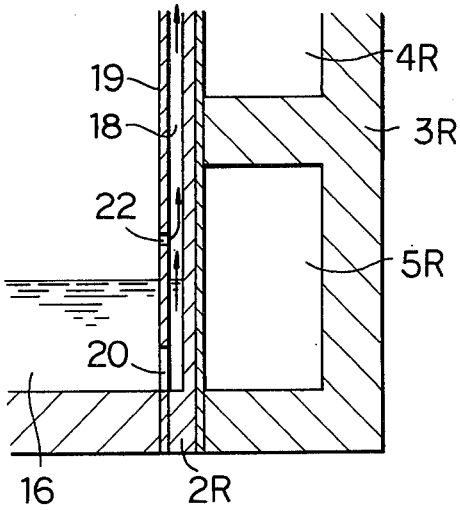
FIG. 3 is an enlarged view of an essential part of FIG. 1.

With reference to the appended drawings, detailed description of the preferred embodiment will be made hereunder.

On each end of a cylinder block, which is made of two parts, a front half 1F and a rear half 1R, are fixed a pair of cylinder housings, 3F and 3R, sandwiching a valve plate, 2F and 2R, therebetween, which valve plate having on either side thereof a reed valve or valves for suction and delivery (this entire body including an intermediate plate functioning as a valve seat and a pair of thin plates containing a reed valve therein is hereafter called valve plate) with the object of controlling the passage of the refrigerant gas mixed with the lubricating oil. Each of the cylinder housings 3F, 3R is divided by a partition or partitions to form a suction chamber 4F (or 4R) and a discharge chamber 5F (or 5R) thereinside. Through the central part of the cylinder block (1F and 1R) is disposed a driving shaft 6, being rotatably supported by radial bearings 7. On the driving shaft 6 is secured a swash-plate 10 with a key (not shown), being supported by thrust bearings 11, in a swash-plate chamber 9, which is defined by a partition wall 8 substantially at the middle position of the cylinder block (1F and 1R).

The swash-plate 10 is, through a shoe 14 and a ball 15, engaged with a plurality of pistons 13, which are fitted in each cylinder bore 12 formed in the cylinder block 1F, 1R; the rotation of the former 10 forcibly reciprocates the pistons 13 in the axial direction in order to compress the refrigerant gas, which contains more or less finely atomized oil therein, returning from the evaporator for recycling it to the condensor. An oil reservoir 16 formed in the cylinder block 1F, 1R is, through the oil returning hole 17 formed in the partition wall 8, communicated with the swash-plate chamber 9. In the rear side valve plate 2R confronting the oil reservoir 16 is formed a vertically extending oil passage 18. In this embodiment the oil passage 18 is formed as a channel shaped groove vertically formed in the valve plate 2R covered by a suction valve 19 (a thin plate involving a reed valve for suction of gas) confronting thereto. It is, however, possible to form this oil passage 18 through and within the substance of the valve plate 2R. This oil passage 18 is, at the lower end thereof, communicated with the oil reservoir 16 through a relatively large through-bore 20, and is, at the upper end thereof, communicated with a supplementary oil reservoir 21 (which is in reality a chamber for containing the mixture of the gas and atomized oil) formed ranging from the cylinder housing 3R to the valve plate 2R. The oil passage 18 is again communicated with the oil reservoir 16 through a gas inducing bore 22 formed in a part of the suction valve 19 at a slightly higher position than the oil level for enabling the blow-by gas staying in the oil reservoir 16 to be flowed into the oil passage 18 through the gas inducing bore 22. On the other hand, the driving shaft 6 is concentrically provided with a passage 23 therethrough, for the mixture of gas and oil, of relatively large diameter (hereinafter simply called L passage), ranging from the middle portion thereof toward the rear side end. The L passage 23 is, at the forward end thereof, communicated with a suitable number of oil distribution bores 24 radially formed in the boss portion of the swash-plate 10, which oil distribution bores 24 being so designed to be open with their end portions on the peripheral surface of the boss portion as to throw or scatter the oil mixed in the blow-by gas to the sliding surfaces of the swash-plate 10 and that of the shoe 14 and ball 15. The driving shaft 6 is also, in the front half thereof, concentrically provided with another passage 25 therethrough, for the mixture of gas and oil, of smaller diameter than the abovementioned L passage (hereinafter simply called S passage), which is at the rear side end communicated with the L passage and at the front side end thereof communicated with the suction chamber 4F on the front side through the shaft sealing portion 26. The above mentioned L passage 23 is communicated, at the rear end thereof, with the supplementary oil reservoir 21, and naturally with the oil passage 18.

Oil supplying function of this mechanism under operating condition will be described hereunder. Under operation the inside of the swash-plate chamber 9 and the oil reservoir 16, which is communicated with the chamber 9, are higher in pressure due to staying of the blow-by gas than that of the suction chambers 4F, 4R; and owing to the rotation of the swash-plate 10, accompanied by the rotation of the driving shaft 6, a centrifugal force directed toward the swash-plate chamber 9 is created in the oil distribution bores 24. These two factors cause a gas flow, between the oil reservoir 16 and the suction chamber 4F, passing through the gas inducing bore 22, the oil passage 18, the L passage 23, and the S passage 25. In other words, as the pressure in the L passage 23 and the S passage 25 is, owing to their being communicated with the suction chamber 4F and to a sucking force caused by the centrifugal force due to the rotation of the swash-plate 10, far lower than that in the oil reservoir 16, the gas staying therein and containing the atomized oil flows through the gas inducing bore 22 into the oil passage 18. The speed of the gas flow at this time is rapidly increased due to the small diameter of the gas inducing bore 22. On the other hand, as the oil passage 18 is at its lower end communicated with the oil reservoir 16 via the through-bore 20, the oil staying in the oil passage 18 tends to be, due to the pressure difference between the inside of the oil reservoir 16 and the upper portion of the oil passage 18, sucked up close to the gas inducing bore 22 for being turbulently mixed with the gas flowed from the gas inducing bore 22 into the oil passage 18 to further flow upwards. This mixture of the gas and oil is flowed in an atomized condition into the supplementary oil reservoir 21 and further lead to the L passage 23 which is formed within the driving shaft 6. The mixture of gas and oil inside the L passage 23 tends to be, due to the centrifugal force caused by the rotation of the driving shaft 6, of higher density in the proximity of the inner periphery of the L passage 23 and of low density around the axial line, and is flowed toward the forward side end of the L passage 23. The mixture of high density is at the same time jetted, through the oil distribution bores 24 due to the centrifugal force, to the sliding portions around the connecting places of the swash-plate 10 and the pistons 13 for lubricating there. As to the mixture of low density flowing through the central portion, away from the inner periphery of the L passage 23, along the axial line, it tends to flow into the S passage 25 formed alike within the driving shaft 6 up to the shaft sealing portion 26 for lubricating it, and also into the suction chamber 4F. What is to be paid attention at this time is that the difference between the diameters of the L passage 23 and the S passage 25 in the vicinity of the swash-plate 10 stems the flow of the high oil content gas into the S passage 25 and naturally into the suction chamber 4F, which means a more efficient separation of the oil from the gas, being a desirable feature for this kind of compressor.

Lubrication of the swash-plate 10 and the related sliding members such as the shoe 14 and ball 15 is, in the swash-plate type compressor of this embodiment, carried out in such a manner as described above in greater detail. And the oil after having lubricated the necessary parts can come back to the oil reservoir 16 through the oil returning bore 17 formed in the partition wall 8 of the swash-plate chamber 9; the oil flowed into the suction chamber 4F, 4R, on the other hand, also comes back together with the blow-by gas to the oil reservoir 16. This lubrication cycle within the compressor mechanism is well designed such that, by means of arranging the large diametered L passage 23 at the rear side and the smaller diametered S passage 25 at the front side, the swash-plate 10 and related sliding members requiring relatively large amount of oil can be supplied with the high density mixture and the shaft sealing portion 26 positioned in the suction chamber 4F can be supplied with the low density mixture as desired, which enables the refrigerant gas in the suction chamber 4F not to be mixed with large amount of oil. Besides, the driving shaft 6, which is subjected to a relatively large tortional moment at the front side where it is connected to the engine, is advantageously provided with a small diametered S passage 25 therein, considering from the standpoint of strength of the driving shaft 6.

Although the swash-plate chamber 9 is communicated with the oil reservoir 16 through the oil returning bore 17 formed in the partition wall 8, in this embodiment, it may be directly connected to the oil reservoir 16 by taking off the partition wall 8 which is for separating the two. The oil in the reservoir 16, in this case, will be largely stirred up by the rotation of the swash-plate 10 into a finely atomized state; the lubrication of the swash-plate 10 and the related sliding members will nevertheless be carried out just like in the previous description. The supplementary oil reservoir 21, which functions in this embodiment as an intermediate body between the oil passage 18 and the L passage 23, may also be omitted so long as the oil passage 18 and the L passage 23 are communicated to each other.

In the above described way this invention has eliminated the conventional disadvantages, without employing even a single oil pump, such that the parts requiring fairly high density oil supplying can be lubricated with a lot of oil and the parts requiring a relatively slight oiling are supplied with low density oil supplying and besides, the lubricating efficiency do not fall even a period of low speed running of the machine. This merit is derived from the advantageously combined design of the compressor: (1) a valve plate 2R confronting the oil reservoir 16 is provided with a vertical oil passage 18 which is communicated with the oil reservoir 16 at the lower end thereof through a relatively large through-bore 20 and is communicated again with the oil reservoir 16 via a gas inducing bore 22 of a small diameter disposed at a place slightly higher than the oil level; (2) the oil in the oil reservoir 16 is sucked up together with the blow-by gas due to the pressure difference between in the oil reservoir 16 and in the suction chamber 4R as well as the centrifugal force produced by the rotation of the driving shaft 6 and the swash-plate 10; and (3) in this instance the disposition of the large diametered L passage 23 and the small diametered S passage 25 formed in the driving shaft 6 and the oil distribution bores 24 drilled through the boss portion of the swash-plate 10 functions quite efficiently for performing the above-mentioned object-suited supplying of lubrication according to the places to be oiled. This invention has thus succeeded in decreasing the number of parts to be assembled, thereby reducing the production cost and in providing a good lubrication even in the low speed operation period to say nothing of the high speed operation period, which has completely solved the seizure prevention problem at the same time.

It will be obvious to those skilled in the art that various changes may be made without departing from the scope of the invention and the invention is not to be considered limited to what is shown in the drawings and described in the specification.

What is claimed is:

1. A swash-plate type compressor including a cylinder block, a pair of cylinder housings, front and rear, a pair of valve plates, an oil reservoir, a driving shaft having a swash-plate secured thereon, a plurality of pistons which are reciprocable in the axial direction within a bore formed in said cylinder block and are actuated by said swash-plate, via a shoe and a ball, to compress the refrigerant gas, said compressor comprising:

a vertical oil passage formed through said rear side valve plate having a through-bore at the lower end thereof to be communicated with said oil reservoir and a gas inducing bore disposed at a slightly higher position than the oil level in said oil reservoir; and a longitudinal lateral passage, for the gas containing atomized oil therein, concentrically bored in said driving shaft, which lateral passage is communicated, at the rear end thereof, with the upper portion of said vertical oil passage.

2. A swash-plate type compressor including a cylinder block, a pair of cylinder housings, front and rear, a pair of valve plates, an oil reservoir, a driving shaft having a swash-plate secured thereon, a plurality of pistons which are reciprocable in the axial direction within a bore formed in said cylinder block and are actuated by said swash-plate, via a shoe and a ball, to compress the refrigerant gas, said compressor comprising:

a longitudinal lateral passage, for the gas containing atomized oil therein, concentrically bored in said driving shaft, being of larger diameter in the rear side thereof and of smaller diameter in the front side thereof, said lateral passage being communicated at the rear side end thereof with a supplementary oil reservoir provided in said rear cylinder housing as a chamber for containing the mixture of the gas and atomized oil and further communicated at the front side end thereof with the shaft sealing portion; and a vertical oil passage formed through said rear side valve plate having a through-bore at the lower end thereof to be communicated with said oil reservoir and a gas inducing bore disposed at a slightly higher position than the oil level in said oil reservoir, said oil passage being communicated at the upper portion thereof with said supplementary oil reservoir.

3. A swash-plate type compressor in accordance with claim 2, wherein said longitudinal lateral passage, for the gas containing atomized oil therein, is communicated at the forward end of said larger diametered portion thereof with a plurality of oil distribution bores disposed in the boss portion of said swash-plate and open at the peripheral surface of said boss portion.

4. A swash-plate type compressor in accordance with claim 2, wherein said oil passage is constructed as a channel shaped groove in said rear side valve plate covered by a thin suction valve involving a gas inducing bore therein.

5. A swash-plate type compressor in accordance with claim 2, wherein said swash-plate is accommodated in a swash-plate chamber defined by a partition wall disposed in said cylinder block.

6. A swash-plate type compressor in accordance with claim 5, wherein said swash-plate chamber is communicated, via a bore for oil returning disposed in said partition wall, with said oil reservoir.

* * * * *